US010443923B2

(12) United States Patent
Jeon et al.

(10) Patent No.: US 10,443,923 B2
(45) Date of Patent: Oct. 15, 2019

(54) REFRIGERATOR

(71) Applicant: SAMSUNG ELECTRONICS CO., LTD., Suwon-si (KR)

(72) Inventors: Sang-woon Jeon, Seoul (KR); Jun-kyo Lee, Seongnam-si (KR); Hyun-il Lee, Seoul (KR); Se-lim Yoon, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 307 days.

(21) Appl. No.: 15/312,833

(22) PCT Filed: Apr. 29, 2015

(86) PCT No.: PCT/KR2015/004348

§ 371 (c)(1),
(2) Date: Nov. 21, 2016

(87) PCT Pub. No.: WO2015/178595

PCT Pub. Date: Nov. 26, 2015

(65) Prior Publication Data

US 2017/0184335 A1 Jun. 29, 2017

(30) Foreign Application Priority Data

May 21, 2014 (KR) ..... 10-2014-0061104

(51) Int. Cl.

| | |
|---|---|
| ***F25D 23/02*** | (2006.01) |
| ***F25D 25/02*** | (2006.01) |
| ***F25D 23/04*** | (2006.01) |

(52) U.S. Cl.
CPC ..... *F25D 23/02* (2013.01); *F25D 23/025* (2013.01); *F25D 23/04* (2013.01); *F25D 25/02* (2013.01); *F25D 25/027* (2013.01)

(58) Field of Classification Search
CPC ..... F25D 23/04; F25D 25/02; F25D 25/027; F25D 23/02
(Continued)

(56) References Cited

U.S. PATENT DOCUMENTS 3,101,227 A * 8/1963 Pugh ..... F25D 25/027 312/296
4,124,262 A 11/1978 Schill
(Continued)

FOREIGN PATENT DOCUMENTS

CN 1676065 10/2005
DE 10 2004 045 476 A1 3/2006
(Continued)

OTHER PUBLICATIONS

International Search Report dated Aug. 18, 2015 in corresponding International Application No. PCT/KR2015/004348.
(Continued)

*Primary Examiner* — David J Teitelbaum
(74) *Attorney, Agent, or Firm* — Staas & Halsey LLP

(57) ABSTRACT

A refrigerator is provided. More particularly, a refrigerator having a rotating guard unit is disclosed. A part of disclosed embodiments provides a refrigerator, in which a door guard of a rotation guard unit rotates in one direction among the clockwise direction and the counterclockwise direction when the rotation guard unit is moved forward.

14 Claims, 22 Drawing Sheets

(58) Field of Classification Search
USPC ..... 211/77, 163, 144, 115, 95, 1.53; 312/125, 135
See application file for complete search history.

(56) References Cited

U.S. PATENT DOCUMENTS

| | | | | |
|---|---|---|---|---|
| 7,270,241 | B2 | 9/2007 | Nobili | |
| 2004/0232810 | A1 | 11/2004 | Kreyenkamp | |
| 2005/0000237 | A1* | 1/2005 | Schmitz | A47F 3/0408 62/246 |
| 2005/0211649 | A1 | 9/2005 | Nobili | |
| 2006/0137375 | A1* | 6/2006 | Lishman | A47B 49/004 62/258 |
| 2010/0193456 | A1 | 8/2010 | Polizzi et al. | |
| 2011/0023528 | A1* | 2/2011 | Kwon | F25D 23/028 62/441 |
| 2011/0083465 | A1* | 4/2011 | Kim | F25D 25/027 62/449 |
| 2013/0033163 | A1 | 2/2013 | Kang | |
| 2013/0154462 | A1 | 6/2013 | Cho et al. | |
| 2013/0199232 | A1 | 8/2013 | Natarajan et al. | |
| 2014/0132144 | A1 | 5/2014 | Kim et al. | |

FOREIGN PATENT DOCUMENTS

| | | | | |
|---|---|---|---|---|
| EP | 2 653 812 | A2 | 10/2013 | |
| EP | 2730867 | | 5/2014 | |
| JP | 4981165 | | 4/2012 | |
| KR | 20-0181518 | | 5/2000 | |
| KR | 20040105176 | A * | 12/2004 | F25D 25/027 |
| KR | 10-2006-0071640 | | 6/2006 | |
| KR | 10-2008-0027648 | | 3/2008 | |
| KR | 10-2013-0015987 | | 2/2013 | |
| KR | 10-2013-0071058 | | 6/2013 | |

OTHER PUBLICATIONS

Written Opinion of the International Search Authority dated Aug. 18, 2015 in corresponding International Application No. PCT/KR2015/004348.
Extended European search report dated Dec. 8, 2017 in corresponding European Patent Application No. 15795789.5. 8 pp.
Chinese Office Action dated Jun. 27, 2018 in Chinese Patent Application No. 201580027279.5.

* cited by examiner

REFRIGERATOR

CROSS-REFERENCE TO RELATED APPLICATIONS

This application is a U.S. National Stage Application, which claims the benefit under 35 U.S.C. § 371 of PCT International Patent Application No. PCT/KR2015/004348, filed Apr. 29, 2015, which claims the benefit of foreign priority from Korean Patent Application No. 10-2014-0061104, filed on May 21, 2014 in the Korean Intellectual Property Office, the disclosures of which are incorporated herein by reference in entirety.

BACKGROUND OF THE INVENTION

Field of the Invention

Apparatuses and methods consistent with the present disclosure relate to a refrigerator, and more particularly, to a refrigerator having a door guard rotating clockwise or counterclockwise.

Description of the Related Art

A refrigerator includes a door rotatably opening and closing a storage room (for example, fridge and/or freezer). Further, the refrigerator includes a double door rotatably opening and closing the storage room (for example, fridge and/or freezer). The double door may include, for example, a first door located outside the storage room and a second door located inside the storage room.

The inside of the first door and the second door of the refrigerator may have a fixed door guard that receives a beverage container in which water and/or beverages are filled When the first door is opened by a user, the user may not easily take beverage containers received near the storage room out of a fixed door guard of the second door. In this case, the user needs to close the first door and then open the second door to take out the beverage containers.

Further, when each of the first door and the second door has the door guard, beverage containers may be easily put in or taken out of a refrigerator. However, in this case, a size of the door guard is reduced, and therefore it is difficult to receive stuff having a large size or a large volume.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present disclosure provides a refrigerator capable of easily receiving stuff having a large size or a large volume.

According to an aspect of the present disclosure, a refrigerator includes: a main body having a storage room; a first door hinge-connected to the main body to rotate at a front of one side of the storage room and having an opening; a second door rotating at the front of the first door to open and close the opening; a third door hinge-connected to the main body to rotate at a front of the other side of the storage room; and a rotation guard unit rotating while being located at the opening of the first door.

The rotation guard unit may include: a door guard; side frames extending in a height direction of the refrigerator to be spaced apart from both sides of the door guard; a top frame located at an upper end of the door guard and connected to one end of the side frame; and a bottom frame located at a lower end of the door guard, having a protruding area protruding toward a front of the storage room, and connected to the other end of the side frame, in which the door guard may have a plurality of rotating shafts located on the same shaft line.

The door guard may rotate through a gap between both sides of the door guard and the side frame.

The bottom frame may have an opening, a rotating shaft of the door guard passing through the opening may be connected to a gear, and the gear at a first location may be located to be spaced from a rack located on a bottom surface of the first door.

The gear may have a plurality of gear teeth and the plurality of gear teeth disposed at the gear at an angle smaller than 360°.

The gear may have a plurality of gear teeth and some of the plurality of gear teeth may have a size smaller than that of other gear teeth.

The number of gear teeth of the gear may correspond to a moving distance of the rotation guard unit.

Modules of gear teeth of the rack engaged with the gear teeth of the gear may be the same.

A linear moving distance from the first location of the gear to a second location may be shorter than that from the second location of the gear to a third location.

A rotation direction of the rotation guard unit may be changed depending on a location of the gear and the rack that are engaged with each other.

In an overall width of the door guard, a width in a direction of the storage room may be larger than that in the front of the storage room, with respect to a center of the gear.

When the second door is closed, the second door may have a groove receiving the protruding region.

The second door may include a fixed door guard that does not overlap a fixed guard of the rotation guard unit.

The bottom frame may further include a lock button located at a front surface of the protruding area and when locking of the bottom frame is released by the lock button, the bottom frame may move in a second direction.

The storage room may include a fridge or a freezer and the rotation guard unit is located at at least one of the fridge and the freezer.

According to another aspect of the present disclosure, a refrigerator includes: a main body having a storage room; a first door rotating at a front of one side of the storage room to open and close a portion of the storage room, having an opening, and having a rotation guard unit included in the opening; a second door rotating at the front of the first door to open and close the opening; and a third door hinge-connected to the main body to rotate at a front of the other side of the storage room, in which the rotation guard unit includes a rotatable door guard and when the rotation guard unit moves from a fixed first location to a front of the first location, the door guard of the rotation guard unit rotates either clockwise or counterclockwise.

The third door may rotate in an opposite direction to the rotation direction of the first door.

According to still another aspect of the present disclosure, a refrigerator includes: a main body having a storage room; a first door rotating at a front of one side of the storage room to be hinge-connected to the main body, opening and closing a portion of the storage room, having an opening, and having a rotation guard unit included in the opening; and a second door rotating at the front of the first door to open and close the opening; in which the rotation guard unit includes a rotatable door guard and when the rotation guard unit moves from a fixed first location to a front of the first location, the door guard of the rotation guard unit rotates either clockwise or counterclockwise.

One of an upper end and a lower end of the storage room may be further provided with another storage room and another storage room may include a third door hinge-connected to rotate at a front of the another storage room.

According to still yet another aspect of the present disclosure, a refrigerator includes: a main body having a storage room; a first door rotating at a front of one side of the storage room to be hinge-connected to the main body, having an opening, and having a rotation guard unit located on a bottom surface of an opening surface corresponding to the opening; a second door rotating at the front of the first door to open and close the opening; and a movement limit member provided on a bottom surface of the first door to contact the rotation guard unit and limiting the movement of the rotation guard unit.

The movement limit member may limit the movement of the rotation guard unit by a lock button of the rotation guard unit.

It is possible to provide the rotation guard unit that is located at the inner door and rotates either clockwise or counterclockwise.

It is possible to provide the refrigerator having the rotation guard unit that is located at the inner door and rotates either clockwise or counterclockwise.

It is possible to provide the refrigerator in which the door guard of the rotation guard unit rotates either clockwise or counterclockwise depending on the drawing out of the rotation guard unit.

In addition thereto, according to various exemplary embodiments of the present disclosure, it is possible to provide the refrigerator in which the door guard of the rotation guard unit rotates either clockwise or counterclockwise.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
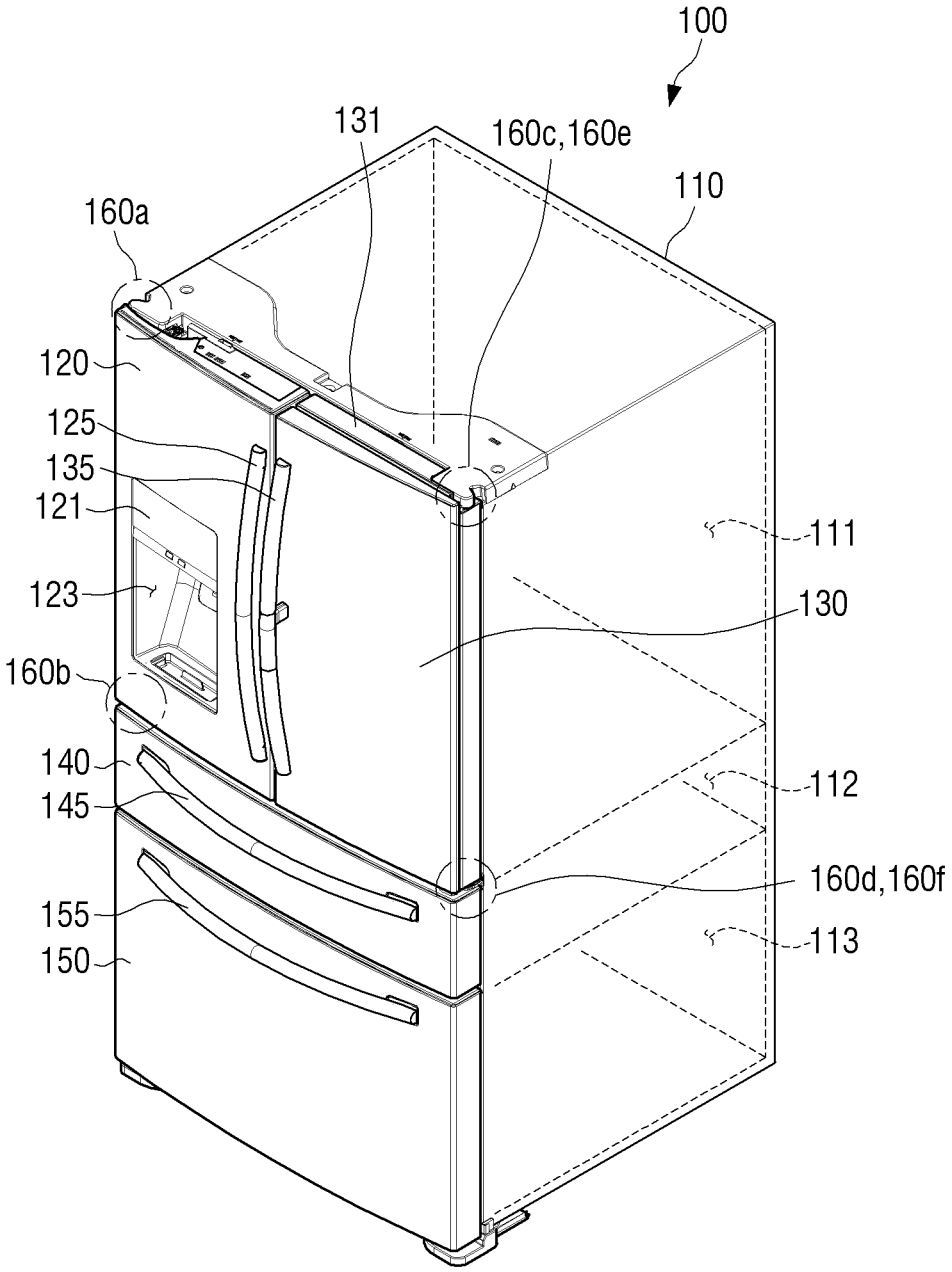
FIG. 1 is a schematic perspective view of a refrigerator according to an exemplary embodiment of the present disclosure.

Hereinafter, exemplary embodiments of the present disclosure will be described in detail with reference to the accompanying drawings. Further, a method for manufacturing and using a refrigerator according to an exemplary embodiment of the present disclosure with reference to contents illustrated in the accompanying drawing will be described in detail. Like reference numerals or symbols of each drawing denote parts or components performing substantially the same functions.

Terms including an ordinal number such as 'first', 'second', etc. can be used to describe various components, but the components are not to be construed as being limited to the terms. The terms are used to distinguish one component from another component. Therefore, the first component may be referred to as the second component, and the second component may be referred to as the first component without deviating from the scope of the present disclosure. The term 'and/or' includes a combination of a plurality of relevant items or any one of a plurality of relevant items.

Terms used in the present specification are used only in order to describe specific exemplary embodiments rather than limiting the present disclosure. Singular forms are intended to include plural forms unless the context clearly indicates otherwise. Throughout this specification, it will be understood that the term "comprise" and variations thereof, such as "comprising" and "comprises", specify the presence of features, numbers, steps, operations, components, parts, or combinations thereof, described in the specification, but do not preclude the presence or addition of one or more other features, numbers, steps, operations, components, parts, or combinations thereof. Like reference numerals proposed in each drawing denote like components.

FIG. 1 is a schematic perspective view of a refrigerator according to an exemplary embodiment of the present disclosure.

Figure 2:
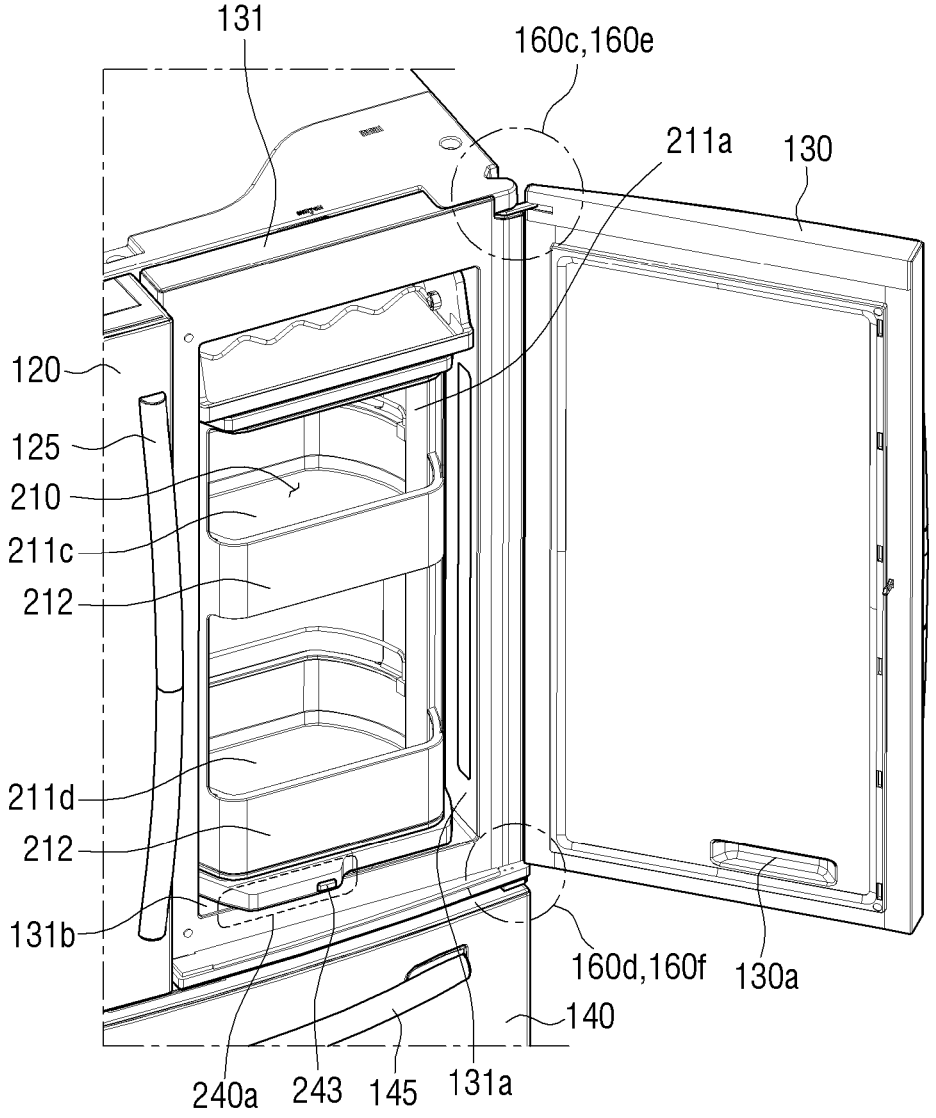
FIG. 2 is a schematic perspective view illustrating a state in which a right of an upper storage room of the refrigerator according to the exemplary embodiment of the present disclosure is open.

FIG. 2 is a schematic perspective view illustrating a state in which a right of an upper storage room of the refrigerator according to the exemplary embodiment of the present disclosure is open.

Figure 3:
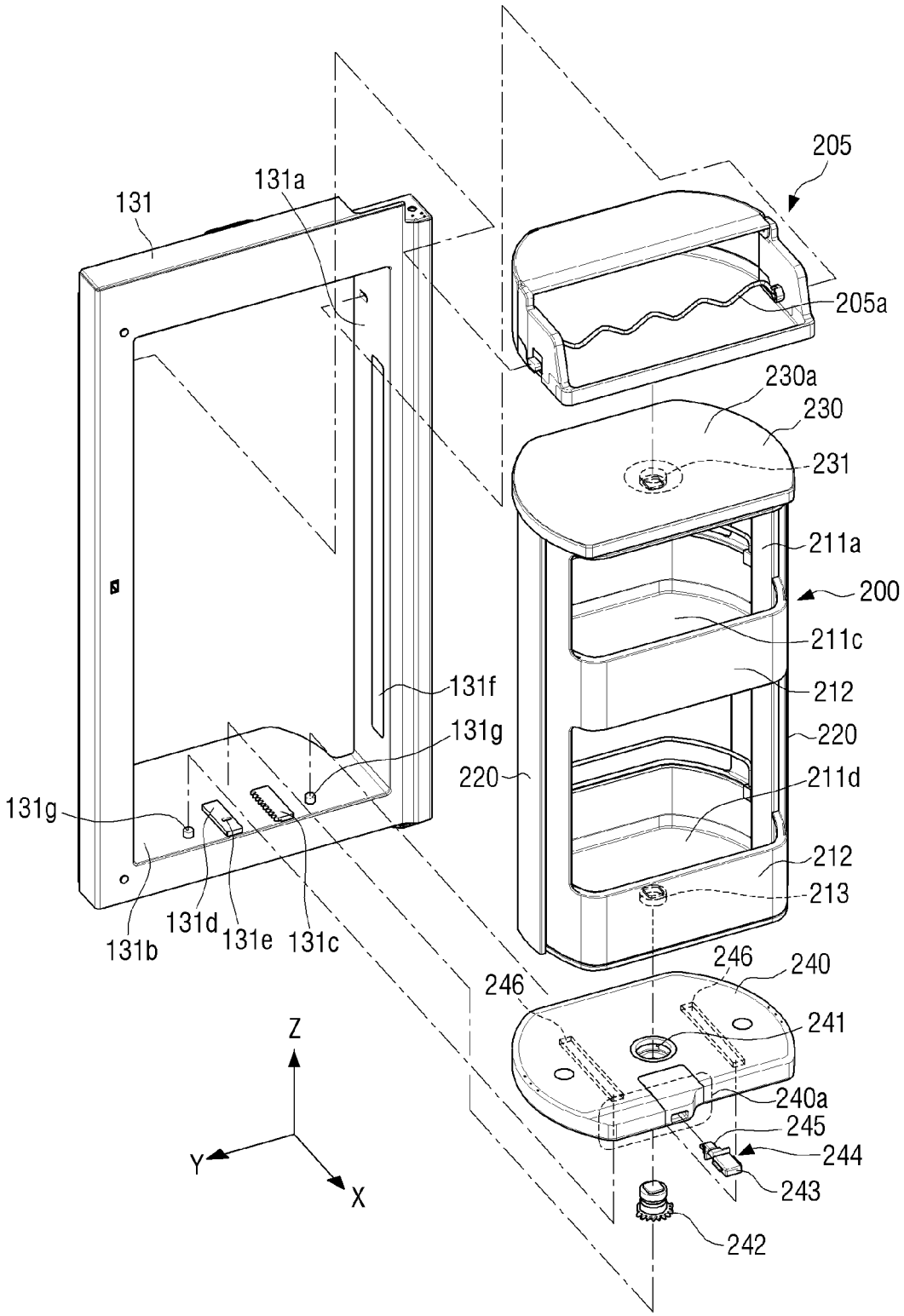
FIG. 3 is a schematic perspective view of components separated from a rotation guard unit of the refrigerator according to the exemplary embodiment of the present disclosure.

FIG. 3 is a schematic perspective view of components separated from a rotation guard unit of the refrigerator according to the exemplary embodiment of the present disclosure.

Referring to FIGS. 1 and 3, a refrigerator 100 includes a main body 110, doors 120, 130, and 131, drawers 140 and 150, and a hinge 160.

The main body 110 includes storage rooms 111 to 113 that are formed in the main body 110, open by the doors 120, 130, and 131 that are opened and closed, and receive water, beverages, chilled or frozen food, or the like. Further, the storage rooms 111 to 113 may store food materials The main body includes an inner case (not illustrated) forming the storage rooms 111 to 113, an outer case (not illustrated) forming an appearance of the refrigerator, and an insulator (not illustrated) maintaining a temperature difference between the inner case (not illustrated) and the outer case (not illustrated). The insulator (not illustrated) may prevent cold air in the storage rooms 111 to 113 from being leaked to the outside and hot air from being introduced into the storage rooms 111 to 113 from the outside.

The main body 110 includes a cold air supply unit (not illustrated) that supplies cold air to the storage rooms 111 to 113. The cold air supply unit (not illustrated) may include a compressor (not illustrated) compressing a refrigerant, a condenser (not illustrated), an expansion valve (not illustrated), an evaporator (not illustrated), and a pipe (not illustrated).

The storage rooms 111 to 113 are divided by a partition (not illustrated). The storage rooms 111 to 113 is divided into lower freezing storage rooms 112 and 113 (hereinafter, referred to as "freezer") and a refrigerating storage room 111 (hereinafter, referred to as "fridge") on the freezers 112 and 113. The storage room 112 may receive water, beverages, food materials, chilled or frozen food, or the like while being set to be temperature above zero (for example, between 7° C. and 0° C.) or temperature below zero (for example, between −1° C. and −5° C.). Water or beverages may be received in a beverage container.

The fridge 111 among the storage rooms 111 to 113 divided by the partition (not illustrated) may include one or plural shelves (not illustrated) and one or plural storage box (not illustrated).

The fridge 111 is coupled with a first door 120 at one side (for example, left) of the storage room 111, a second door 130 close to the first door 120 and located at the other side (for example, right) of the storage room 111, and a third door 131 having an opening. The first door 120, the second door 130, and/or the third door 131 may rotate at an angle (for example, 300° or less) set by hinges 160*a* to 160*f* to open and close (for example, couple or separate) a front surface of the storage room 111. The first door 120 rotates in an opposite direction to the rotation direction of the third door 131 to be able to open and close the storage room 111. Further, the first door 120 rotates in an opposite direction to the rotation direction of the second door 130 and the third door 131 to be able to open and close the storage room 111.

Locations of the first door 120 and the second door 130 and the third door 131 may be changed to each other. For example, the first door 120 may be located at the right of the storage room 111 and the second door 130 and the third door 131 may be located at the left of the storage room 111.

The first door 120 rotates at the angle (for example, 300° or less) set by the hinges 160*a* and 160*b* to open and close a portion (for example, between 35 to 60% of the front surface of the storage room 111) of the front surface of the storage room 111.

A surface of the first door 120 may be provided with an operation panel 121 that displays functions and settings of the refrigerator 110 and may be changed by a user input (for example, touch or selection of a button), a dispenser 123 that provides water, ice, or sparkling water, and/or a grippable handle 125.

The second door (or outer door) 130 and/or the third door (or inner door) 131 rotates at the angle (for example, 300° or less) set by the hinges 160*c* to 160*f* to open and close a portion (for example, between 15 to 60% of the front surface of the storage room 111) of the front surface of the storage room 111. The second door 130 may include a grippable handle 135. The handle 125 of the first door 120 and the handle 135 of the second door 130 are disposed to be space apart from each other with respect to a central area of the storage room 111.

The second door 130 that is the outer door is located in front of the third door 131 that is the inner door and the second door 130 rotates at the angle (for example, 300° or less) set by the hinges 160*e* and 160*f* to open and close the front surface of the third door 131. The hinges 160*e* and 160*f* of the second door 130 and the hinges 160*c* and 160*d* of the third door 131 are located on the same axis (for example, height direction of a refrigerator) and are spaced apart from each other.

The third door 131 may include an opening, an inner top surface (not illustrated), an inner side surface 131*a*, an inner bottom surface 131*b*, a rack 131*c*, a brace 131*d*, a locking hole 131*e*, and a side illuminator 131*f*. The inner top surface (not illustrated), the inner side surface 131*a*, and the inner bottom surface 131*b* that form the opening (or correspond to the opening) may be called an opening surface of the third door 131.

When the second door 130 is opened by a user, a rotation guard unit 200 and a can shelf 205 located at the third door 131 are displayed. The rotation guard unit 200 is spaced apart from the inner side surface 131*a* of the third door 131. A door guard 210 may rotate clockwise or counterclockwise through a gap between the door guard 210 and the inner side surface 131*a* of the third door 131. One or two or more cans (not illustrated) may be placed on the can shelf 205 by a wire 205*a*.

The rotation guard unit 200 includes the door guard 210, a side frame 220, a top frame 230, and a bottom frame 240.

Figure 4A:
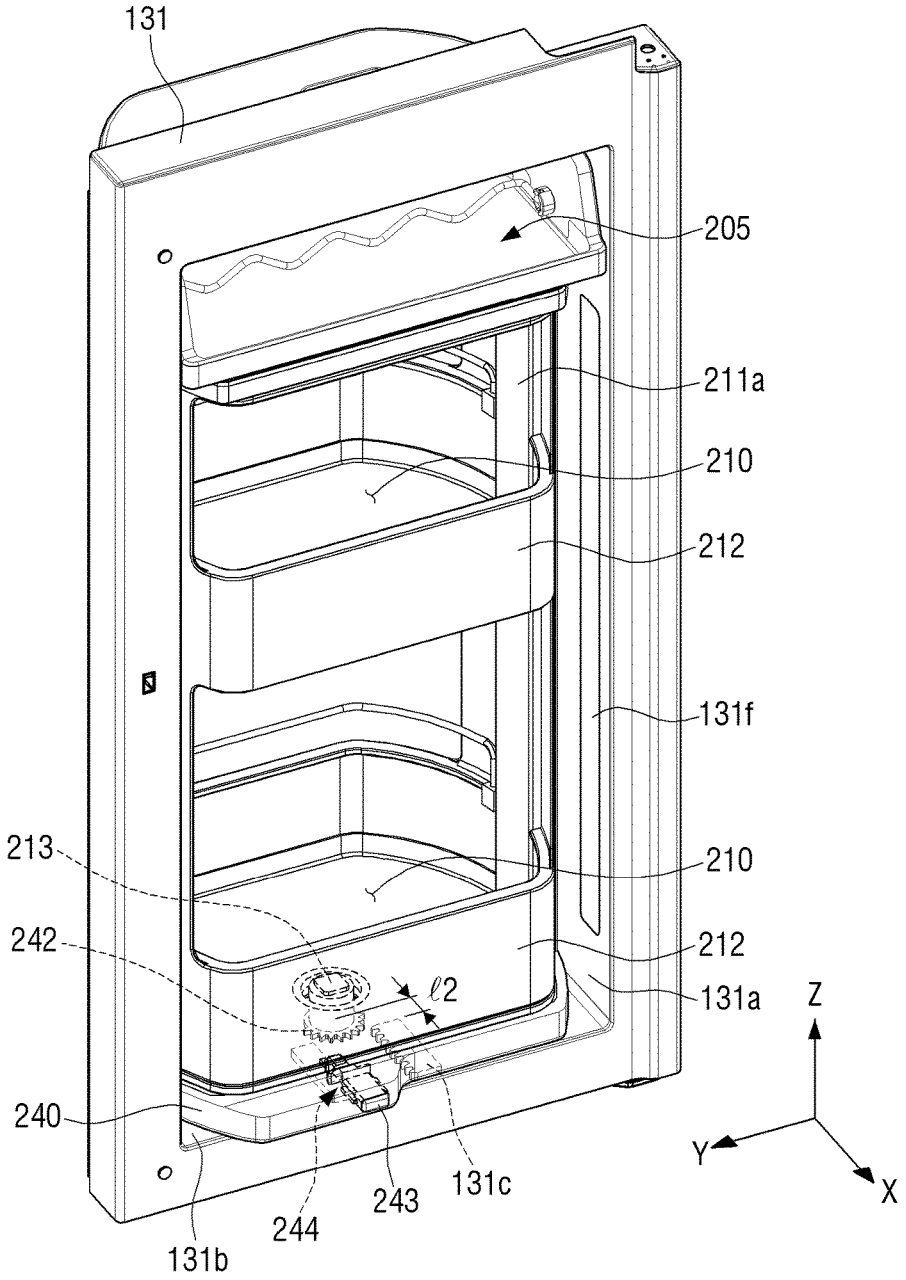
FIGS. 4A to 4E are schematic perspective views illustrating a case in which the rotation guard unit of the refrigerator according to the exemplary embodiment of the present disclosure rotates.
Figure 4B:
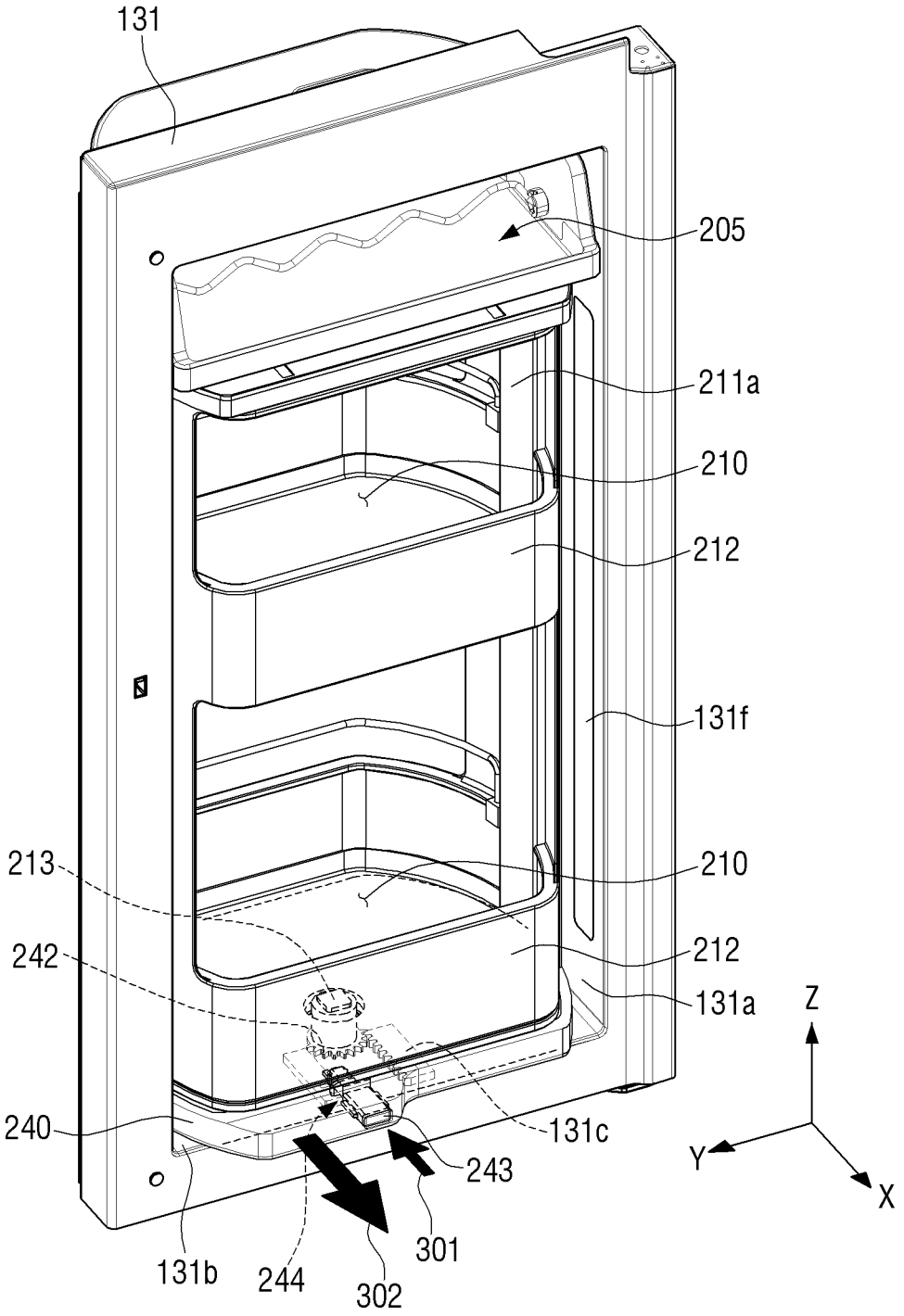
Figure 4C:
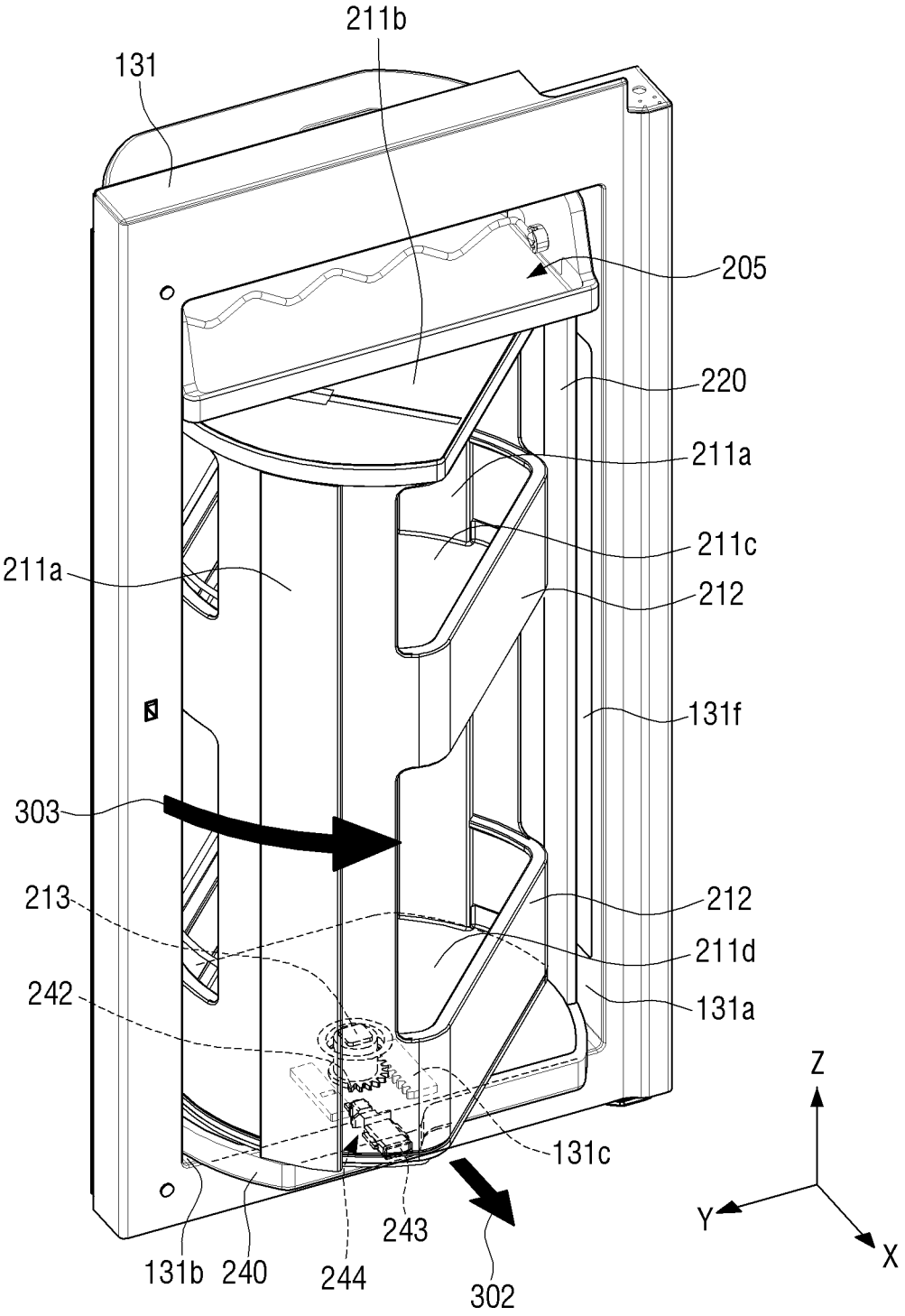
Figure 4D:
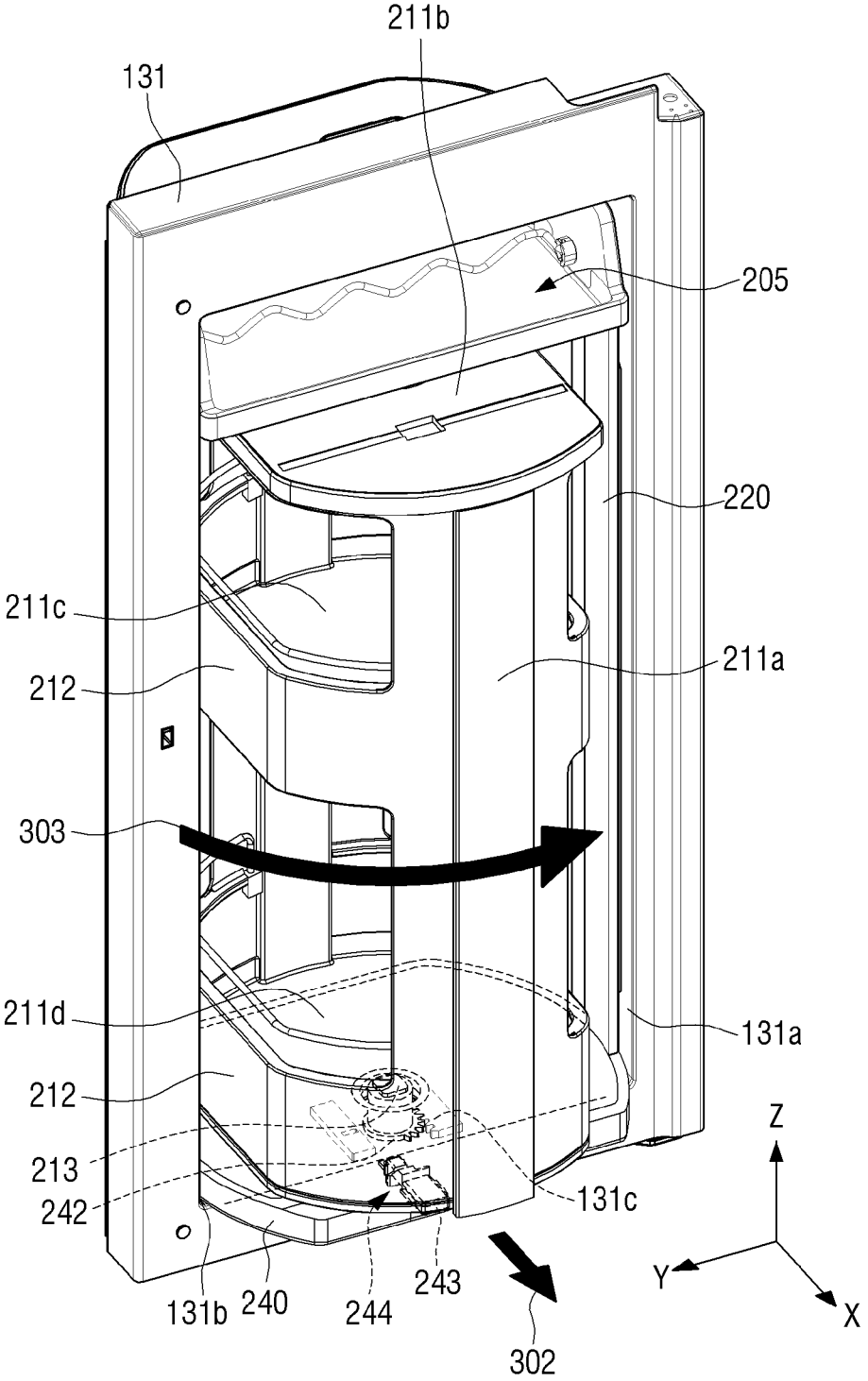
Figure 4E:
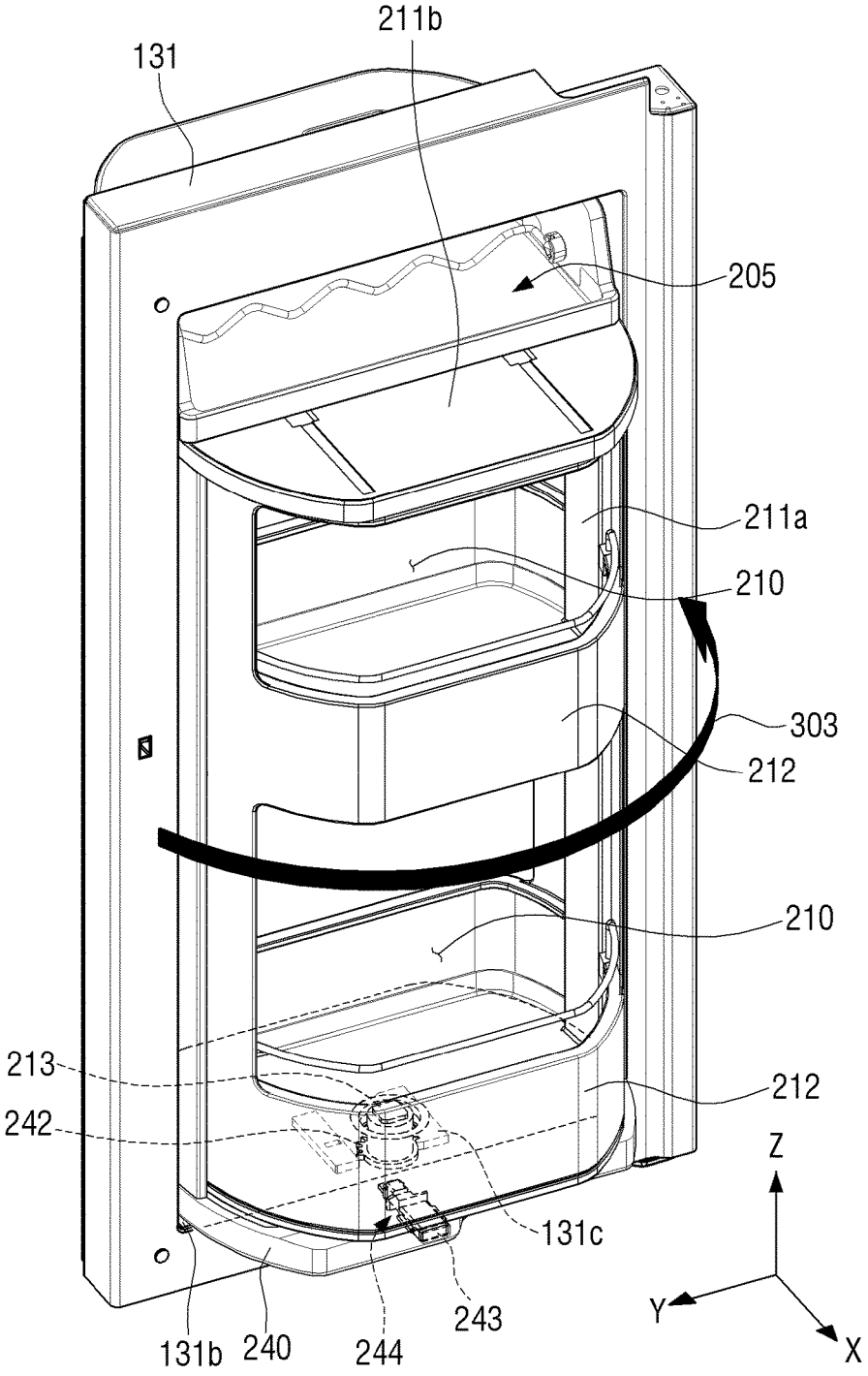

The door guard 210 may receive beverage containers, food, or the like. The door guard 210 may include an inner guard member 211 and an outer guard member 212. The inner guard member 211 may include a middle area 211*a* at both sides of the door guard 210, a top surface 211*b* (refer to FIG. 4C), and bottom surfaces 211*c* and 211*d*. The inner guard member 211 may support the received water or beverages. The inner guard member 211 may be made of a transparent material to transmit light output from the side illuminator 131*f* well. Further, the inner guard member 211 may also be made of an opaque material. When the door guard 210 rotates, the beverage containers received in the door guard may be easily checked by the light from the side illuminator 131*f* input through the inner guard member 211.

The outer guard member 212 is located outside the inner guard member 211 (for example, encloses the inner guard member 211). Each of the outer guard members 212 may have openings through which the received water or beverages are taken out. The outer guard member 212 may support the received water or beverages to prevent it from going over the door guard 210. The outer guard member 212 may be made of a transparent material to transmit light output from the side illuminator 131*f* well. Further, the outer guard member 212 may also be made of an opaque material. When the door guard 210 rotates, the beverage containers received in the door guard may be easily checked by the light from the side illuminator 131*f* input through the outer guard member 212.

One or plural door guards 210 may be formed by a coupling of the inner guard member 211 and the outer guard member 212. The bottom surface 211*d* of the inner guard member 211 may include a first rotating shaft 213 of the rotation guard unit 200 that may rotate. The top surface 211*b* (refer to FIG. 4C) of the inner guard member 211 may include a second rotating shaft 231 of the rotation guard unit 200 that may rotate.

Besides the inner guard member 211 and the outer guard member 212, the door guard 210 may be formed by a coupling of added guard members (not illustrated). Further, one guard member (not illustrated) that is integrally formed may also be formed as a door guard (not illustrated).

It will be easily understood by a person having ordinary skill in the art that the number and/or size of components included in the door guard 210 may be changed depending on a structure of the rotation guard unit 200 and a size or a load of the received water or beverages.

A component rotating in the rotation guard unit 200 may be the door guard 210. The rotating door guard 210 may also be called a rotating guard.

The side frame 220 is located to be spaced apart from both sides (for example, inner guard member 211) of the door guard 210. The number of side frames 220 may be one or plural. The side frame 220 has a curvature (for example, protruding with respect to the rotating shaft of the rotating guard 200) to smoothly rotate the door guard 210 and/or use a space of the door guard 210. The side frame 220 is spaced by a gap (for example, 1 mm to 5 mm or less) between the side frame 220 and the inner side surface 131*a* of the third door 131. The gap between the side frame 220 and the inner side surface 131*a* of the third door may be up to 20 mm. As the gap between the side frame 220 and the inner side surface 131*a* of the third door 131 is increased, the space utilization of the door guard 210 may be reduced.

It will be easily understood by a person having ordinary skill in the art that the gap between the side frame 220 and the inner side surface 131*a* of the third door 131 may be changed depending on a structure of the rotation guard unit 200 and a size or a load of the received water or beverages.

The side frame 220 is spaced by a gap (for example, 0.3 mm to 2 mm or less) to correspond to the inner guard member 211 and/or the outer guard member 212 that rotates with respect to the rotating shafts 213 and 231.

The door guard 210 may rotate clockwise or counter-clockwise through a gap between the door guard 210 and the side frame 220. As the gap between the side frame 220 and the guard members 211 and 212 is increased, the space utilization of the door guard 210 may be reduced.

The top frame 230 is connected to one end of one or plural side frames 220. The top frame 230 may limit a deformation of in an X-axis direction, a Y-axis direction, and/or a Z-axis direction the connected side frame 220. The top frame 230 may be connected to the inner side surface 131*a* of the third door 131 by various fastening members (for example, screw, rivet, hook, adhesive tape, adhesive, or the like). Further, the top frame 230 may slide along the inner side surface 131*a* of the third door 131 in response to the drawing out of the bottom frame 240. For example, the top frame 230 may slide by an elastic projection (not illustrated) of the inner side surface 131*a* and a guide rail (not illustrated) of the top frame 230.

The top frame 230 may include a groove (not illustrated) corresponding to the second rotating shaft 231 that is located on the top surface 211*b* of the rotation guard unit 200. The second rotating shaft 231 of the rotation guard unit 200 may rotate while contacting or not contacting a bottom of the groove (not illustrated) of the top frame 230 in response to the rotation of the first rotating shaft 213. A top surface 230*a* of the top frame 230 may be spaced apart (for example, 15 mm or less) from the can shelf 205 or contact the can shelf 205.

The bottom frame 240 is connected to the other end of one or plural side frames 220. The bottom frame 230 may limit the deformation in the X-axis direction, the Y-axis direction, and/or the Z-axis direction of the connected side frame 220 together with the top frame 230. The bottom frame 240 has an opening 241 through which the first rotating shaft 213 penetrates. The first rotating shaft 213 penetrating through the opening 241 may be coupled with a gear 242. The gear 242 of the first rotating shaft 213 is located to be spaced apart from the inner bottom surface 131*b* of the third door 131 and may contact or may not contact the rack 131*c* depending on a location of the gear 242 (for example, movement in the X-axis direction). The rotation guard unit 200 may rotate depending on the contact between the gear 242 and the rack 131*c*.

The bottom frame 240 has a height (for example, 15 mm to 30 mm) corresponding to the Z-axis direction and may have a protruding area 240*a* protruding toward the second door (for example, X-axis direction, toward the front of the storage room, or direction 302 (refer to FIG. 4B)). The bottom frame 240 may include a lock button 243 located at a front surface (for example, closed second door direction) of the protruding area 240*a*, a first latch 244, in which one end of the first latch 244 extending in a pressed direction (for example, a –X-axis direction or direction 304 (refer to FIG. 6F) that is an opposite direction of the closed second door) of the lock button 243 has an inclined plane 244*a* (refer to FIG. 5B) and a second latch 245 having a second inclined plane 245*a* (refer to FIG. 5B) contacting the inclined plane 244*a*. The first latch 244 may include an elastic member (not illustrated).

The second latch 245 may include an elastic member (not illustrated). The second latch 245 that performs an up-and-down motion by the contact between the inclined plane 244*a* of the first latch 244 and the second inclined plane 245*a* may be inserted into the locking hole 131*e* of the brace 131*d* or may be spaced apart from the locking hole 131*e*.

When the lock button 243 is unlocked, the bottom frame 240 may move in an X-axis direction.

Figure 6A:
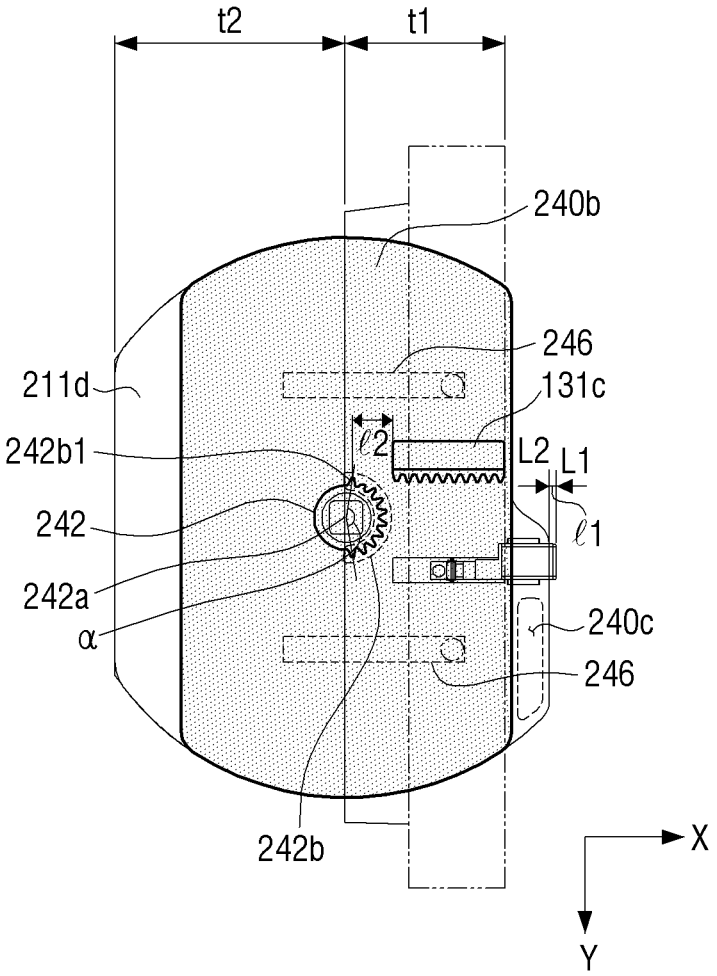
FIGS. 6A to 6H are schematic plan views of a gear and a rack when the rotation guard unit of the refrigerator according to the exemplary embodiment of the present disclosure rotates.
Figure 6B:
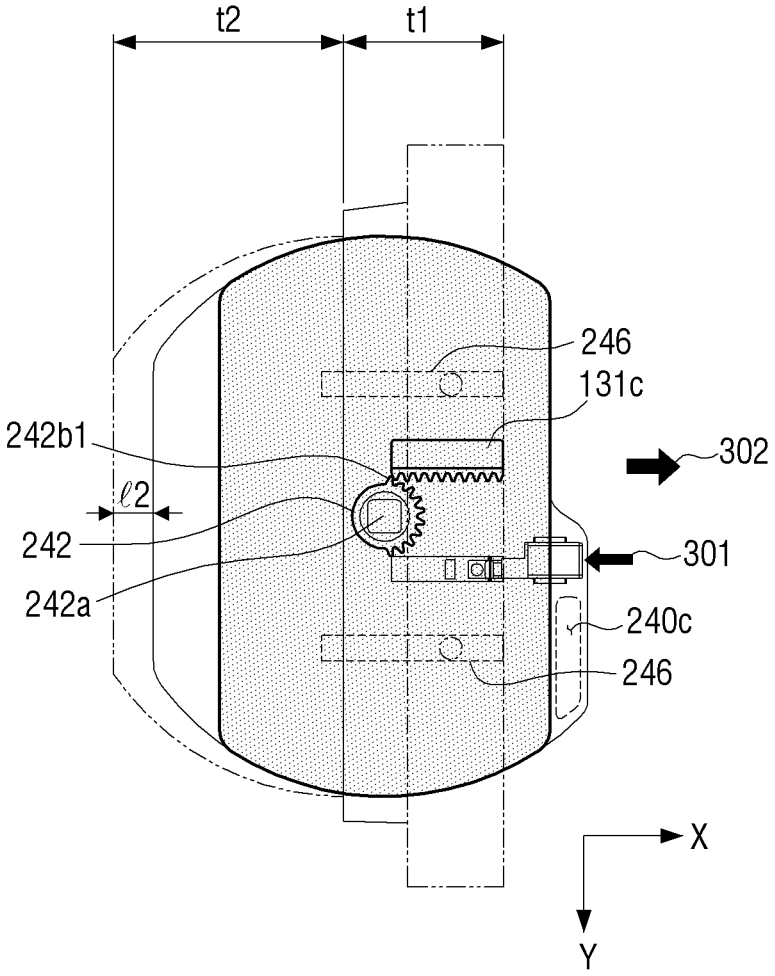
Figure 6C:
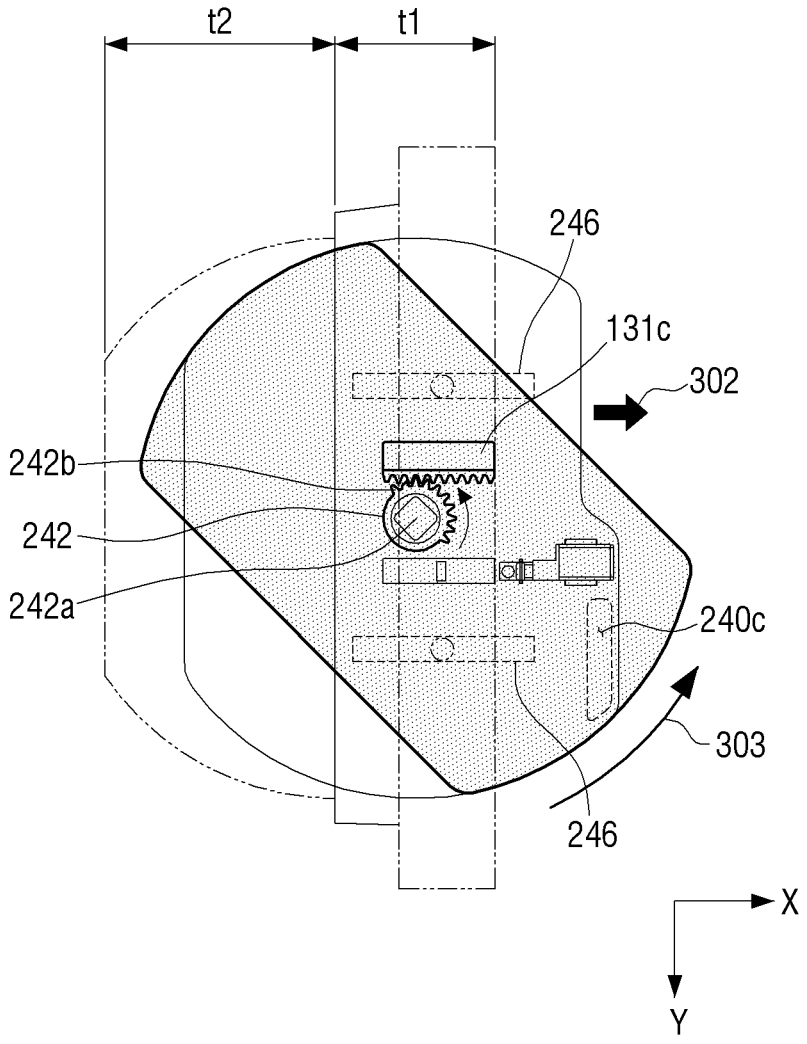

A bottom surface 240*b* (refer to FIG. 6A) of the bottom frame 240 facing the inner bottom surface 131*b* of the third door 131 may be provided with a guide rail 246 (refer to FIG. 6A). The rotation guard unit 200 may be drawn out in the second door direction (for example, X-axis direction) through the guide rail 246.

A groove 130*a* into which all or some of the protruding area 240*a* of the bottom frame 240 may be inserted is located on a back surface of the second door 130. A width of the groove 130*a* is enough to allow the protruding area 240 to be inserted thereinto. Further, a depth of the groove 130*a* is enough not to contact the lock button 243 at a locked location L1 on the bottom frame 240.

The second door 130 according to another exemplary embodiment of the present disclosure may have a fixed door guard (not illustrated). The fixed door guard (not illustrated) of the second door 130 does not overlap the door guard 210 of the rotation guard unit 200 of the third door 131. For example, when the second door 130 and the third door 131 are closed, the opening of the door guard 210 of the rotation guard unit 200 of the third door 131 may be provided with the fixed door guard (not illustrated) of the second door 130.

The drawers 140 and 150 are located under the doors 120, 130, and 131. The drawers 140 and 150 may be drawn out (for example, slid or rolled) in the X-axis direction. Each of the drawers 140 and 150 may have handles 145 and 155.

The drawers 140 and 150 according to another exemplary embodiment of the present disclosure may be changed to plural doors (not illustrated). The storage rooms 112 and 113 may be combined into one storage room like one storage room (for example, storage room 111). Each of the left and right of one storage room (not illustrated) may be provided with doors (not illustrated) like the storage room 111. The refrigerator may have plural (for example, five) doors without drawers (not illustrated).

Only one side of the storage room according to another exemplary embodiment of the present disclosure may be provided with doors (for example, first and second doors (not illustrated) having the rotation guard unit) without having the plural doors provided on both sides thereof). For example, referring to FIG. 1, one side of the storage room 111 may be coupled to the doors (for example, first and second doors (not illustrated) having the rotation guard unit). In the refrigerator, one storage room (not illustrated) may be provided with only one door (for example, first and second doors having the rotation guard unit).

A refrigerator according to another exemplary embodiment of the present disclosure has two storage rooms (not illustrated), in which one side of a first storage room (not illustrated) may be provided with doors (for example, first and second doors (not illustrated) having the rotation guard unit). One of an upper end and a lower end of the first storage room (not illustrated) may be provided with a second storage room (not illustrated). The second storage room (not illustrated) may have one of a third door and a drawer.

FIGS. 4A to 4E are schematic perspective views illustrating a case in which the rotation guard unit of the refrigerator according to the exemplary embodiment of the present disclosure rotates.

Figure 5A:
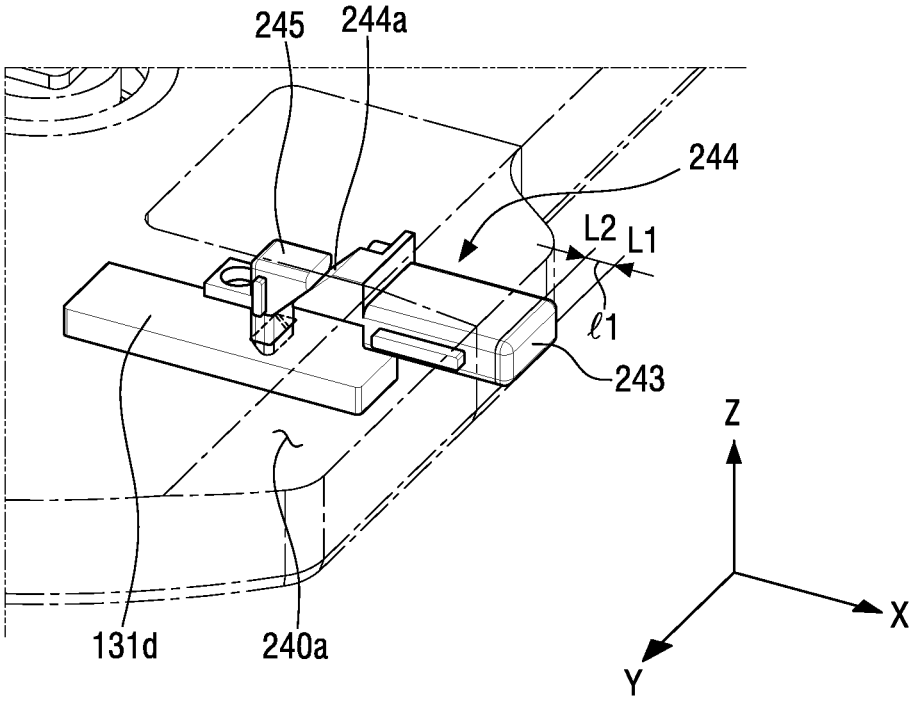
FIGS. 5A and 5B are schematic perspective views illustrating a case in which a lock button in the rotation guard unit of the refrigerator according to the exemplary embodiment of the present disclosure is pressed.
Figure 5B:
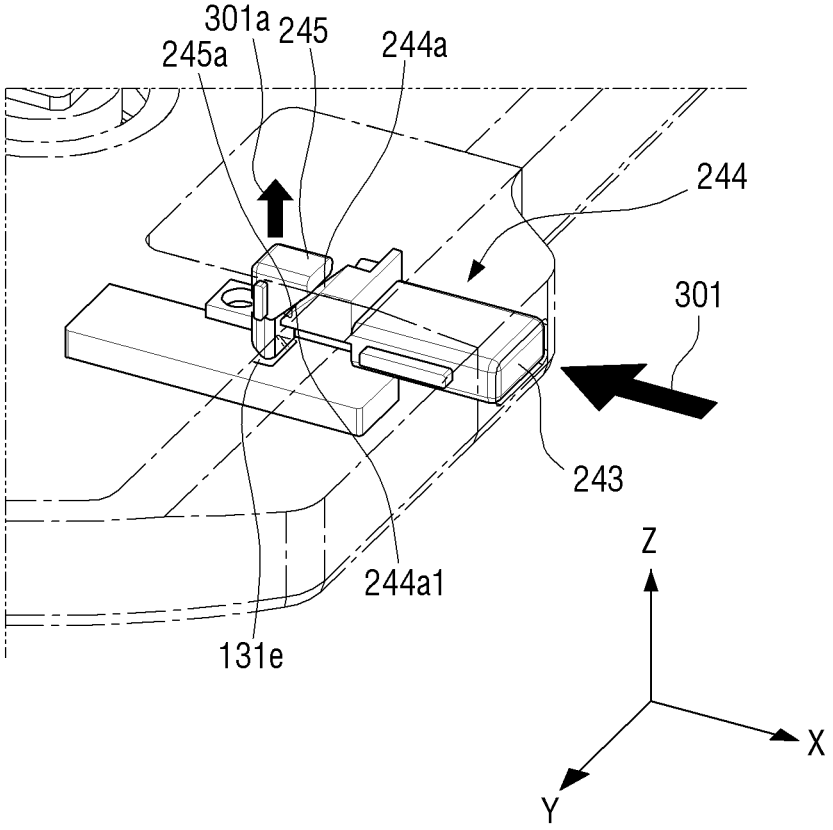

FIGS. 5A and 5B are schematic perspective views illustrating a case in which a lock button in the rotation guard unit of the refrigerator according to the exemplary embodiment of the present disclosure is pressed.

FIGS. 6A to 6E are schematic plan views of a gear and a rack when the rotation guard unit of the refrigerator according to the exemplary embodiment of the present disclosure rotates.

Figure 7A:
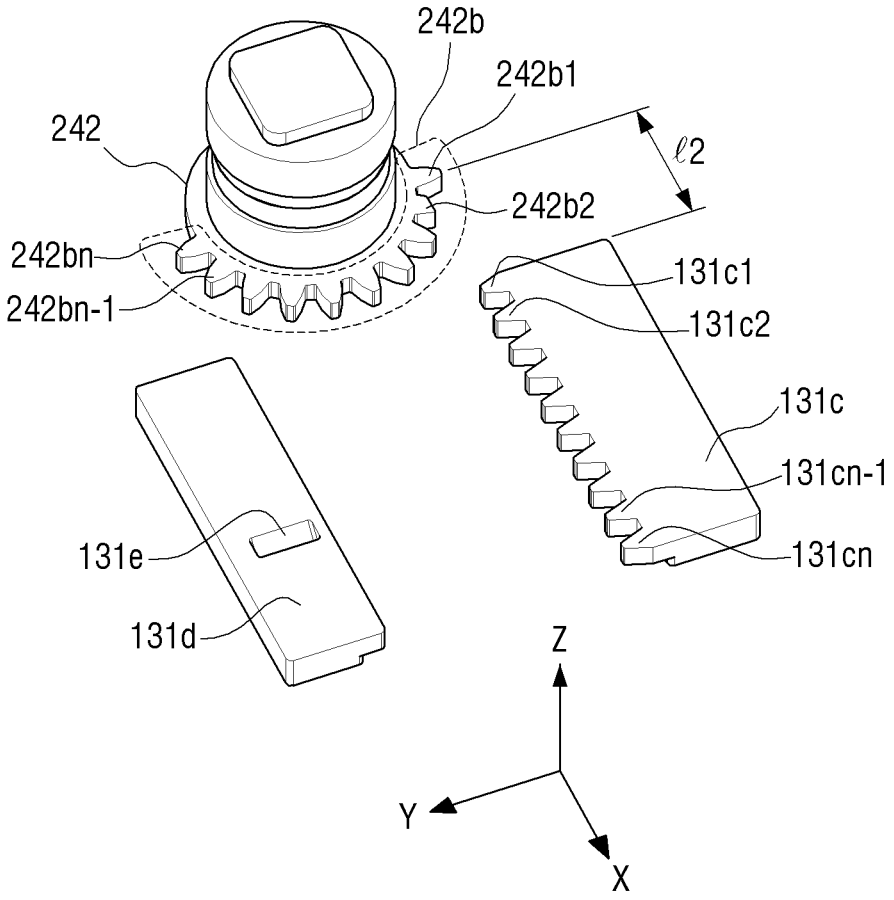
FIGS. 7A and 7B are schematic perspective views of the gear and the rack of the rotation guard unit drawn out of the refrigerator according to the exemplary embodiment of the present disclosure.
Figure 7B:
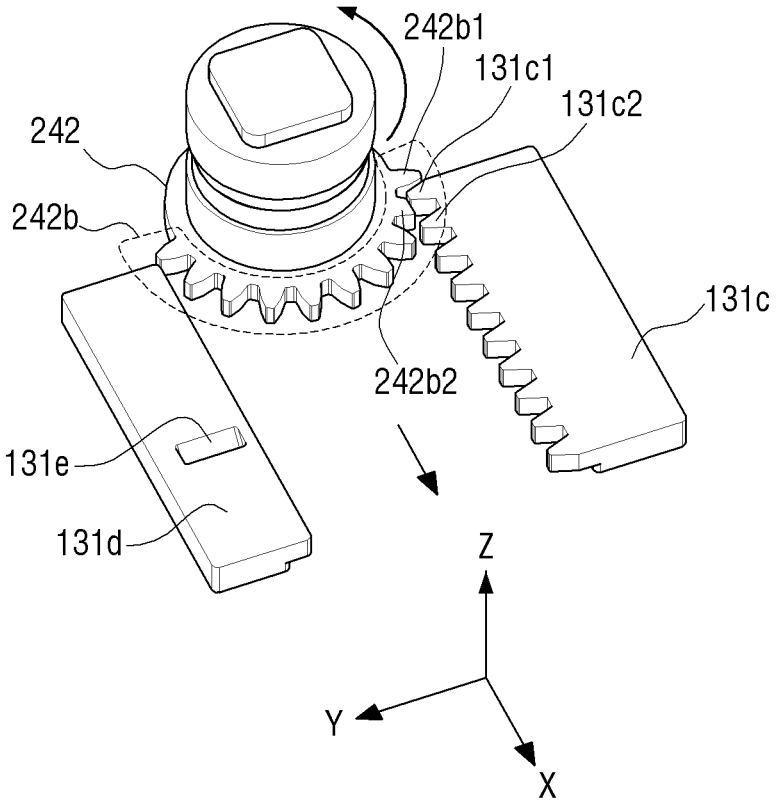

FIGS. 7A and 7B are schematic perspective views of the gear and the rack when the rotation guard unit is drawn out of the refrigerator according to the exemplary embodiment of the present disclosure.

Figure 8:
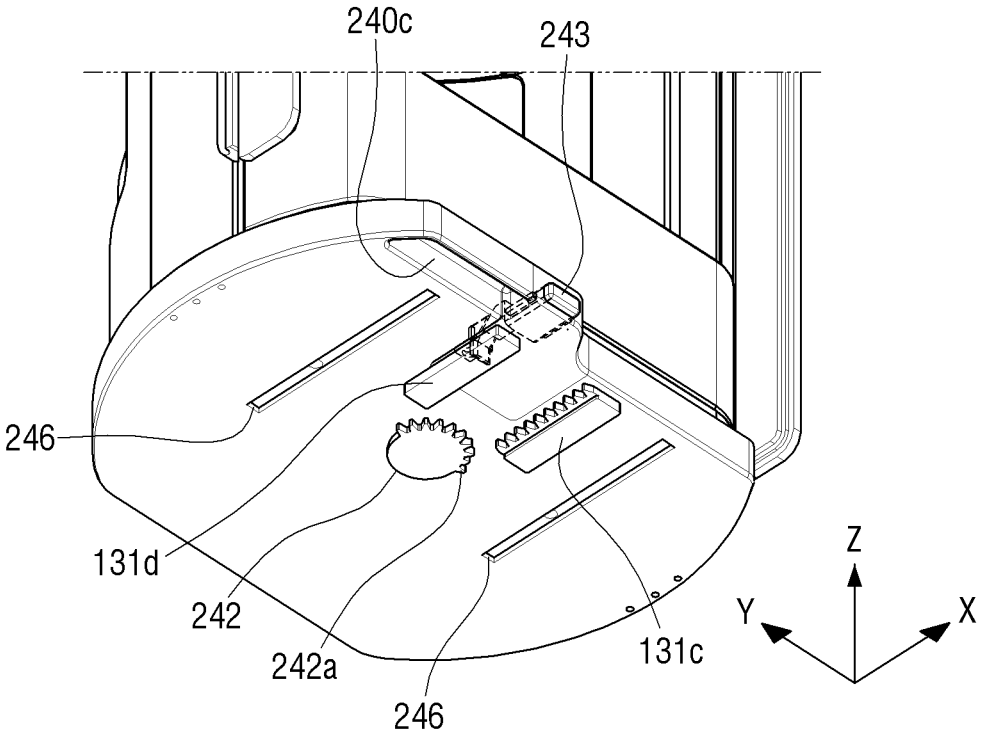
FIG. 8 is a schematic perspective view of the gear of the rotation guard unit of the refrigerator according to the exemplary embodiment of the present disclosure and the rack and a brace of an inner bottom surface.

FIG. 8 is a schematic perspective view of the gear of the rotation guard unit of the refrigerator according to the exemplary embodiment of the present disclosure and the rack and the brace of the bottom surface.

Referring to FIGS. 4A, 5A, 6A, 7A, and 8, when the second door 130 is closed or the closed second door is first opened, the rotation guard unit 200 is at a first location before movement. The angle (for example, based on the Y-axis direction) of the rotation guard unit 200 at the first location is 0° and then the rotation of the rotation guard unit 200 will be described based on the first location.

The bottom frame 240 may include a groove 240*c* (which may be gripped with, for example, a finger, refer to FIG. 6A) that is formed on one side of the lock button 243 and/or a back surface of the protruding region 240*a*. The bottom frame 240 may be drawn out in the second door direction (for example, X-axis direction) by the user.

In the rotation guard unit 200 at the first location, the gear 242 is spaced apart from a rack 243 by a distance l2. For example, the l2 may be 28 mm. Further, the l2 may be about 10 to 45 mm.

The second latch 245 is inserted into the locking hole 131*e* of the brace 131*d* by the lock button 243 at the first location. When the second latch 245 is inserted into the locking hole 131*e*, the bottom frame 240 is not pulled (for example, not moved) in the X-axis direction (for example, direction 302) by the user. The brace 131*d* that limits the movement (or rotation) of the bottom frame 240 of the rotation guard unit 200 may be called a movement limit member (or rotation limit member). The brace 131*d* may limit the movement of the rotation guard unit 200 by the lock button 243 at the first location. The brace 131*d* may limit the movement of the rotation guard unit 200 by one of the lock button 243 at the first location, the first latch 244, and the second latch 245. Further, the brace 131*d* may limit the movement of the rotation guard unit 200 by a combination of the lock button 243 at the first location, the first latch 244, and the second latch 245.

A portion of the inclined plane 244*a* of the first latch 244 and a portion of the inclined plane 245*a* of the second latch 245 may face contact each other. As the moving distance in the −X-axis direction of the first latch 244 is increased by the pressing of the lock button 243, a tip 243*a*1 of the inclined surface 244*a* may be closer to the locking hole 131*e* in the −X-axis direction.

The gear 242 coupled to the first rotating shaft 213 has a gear tooth 242*b*. The gear 242 may have the gear tooth 242*b* by some angle α of 360° with respect to the center of the gear 242. For example, some angle α of the gear tooth 242*b* may be equal to or less than 165°. Further, some angle α may be equal to or less than 180°. Some of the gear teeth 242*b* may collide with a rack 131*c*1 and thus may be damaged. Some angle α may be an angle corresponding to the moving distance in the X-axis direction of the gear 242 engaged with the rack 131*c*.

A gear tooth 242*b*2 may have gear tooth that is partially (for example, gear teeth from a top land to a dedendum circle) cut. Further, the gear tooth 242*b*2 may have gear tooth that is partially (for example, gear teeth from a top land to a pitch circle) cut.

A width (for example, t1+t2) of the bottom surface 211*d* at the inner guard member 11 is larger than that of the bottom surface 240*b* of the bottom frame 240. For example, t1 may be 97 mm and t2 may be 140 mm. Further, the t1 may be 75 to 120 mm. Further, the t2 may be 100 to 180 mm. For example, when the width of the bottom surface 211*d* of the inner guard member 211 is wide, it will be easily understood by a person having ordinary skill in the art that values of the t1 and the t2 may be changed.

When the door guard (or rotating guard 210) rotates at the first location by an external force, the outer guard member 212 of the rotating guard 210 may collide with the shelf (not illustrated) inside the storage room 111 or the storage box (not illustrated).

Referring to FIGS. 4B, 5B, 6B, 7B, and 9, when the lock button 243 is pressed (for example, direction 301) by the user, the lock button 243 moves by a distance l1 from the locked location L1 (refer to FIG. 5A) of the lock button before the lock button 243 is pressed to the unlocked location L2 (refer to FIG. 5B) of the lock button. The distance l1 may be, for example, 1.5 to 10 mm. When the pressing of the lock button 243 is released by the user, the lock button 243 at the unlocked location L2 returns to the locked location L1 by the elastic member (for example, spring, or the like).

When the lock button 243 is pressed by the user and the bottom frame 240 is pulled in the X-axis direction (for example, direction 302), the rotation guard unit 200 moves in the X-axis direction. When the rotation guard unit 200 moves by a gap l2 between the gear 242 and the rack 131*c*, the gear 242 and the rack 131*c* may contact (for example, second location) each other.

Figure 9:
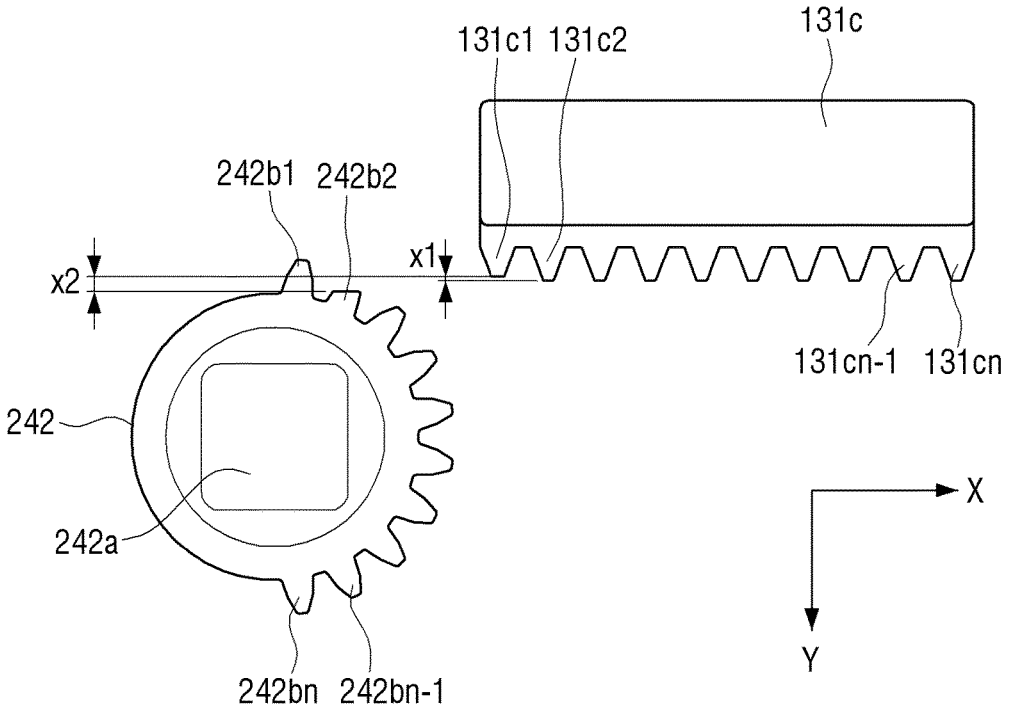
FIG. 9 is a schematic plan view of the gear and the rack of the refrigerator according to the exemplary embodiment of the present disclosure.

FIG. 9 is a schematic plan view of the gear and the rack of the refrigerator according to the exemplary embodiment of the present disclosure.

Referring to FIG. 9, the gear tooth 242*b*2 partially cut reaches a rack gear tooth 131*c*1 earlier than a gear tooth 242*b*1. The first reached gear tooth 242*b*2 partially cut may pass through the rack gear tooth 131*c*1 and reach a subsequent continued rack gear tooth 131*c*2.

A height of the gear tooth 242*b*2 partially cut is lower than that of the gear tooth 242*b*1. Further, a height of the rack gear tooth 131*c*1 is different from that of the rack gear tooth 131*c*2. Further, the height of the rack gear tooth 131*c*1 is lower than that of the rack gear tooth 131*c*2. A difference x1 between the height of the rack gear tooth 131*c*1 and the height of the rack gear tooth 131*c*2 may be 0.56 mm. Further, the difference x1 between the height of the rack gear tooth 131*c*1 and the height of the rack gear tooth 131*c*2 may be equal to or less than 0.9 mm. A difference x2 between a height of the top land of the rack gear tooth 131*c*1 and a height of the top land of the gear tooth 242*b*2 partially cut may be equal to or less than 1.51 mm.

Before the gear tooth 242*b*1 contacts the rack gear tooth 131*c*1, the gear tooth 242*b*2 partially cut may be located between circular pitches of the two rack gear teeth 131*c*1 and 131*c*2.

Referring to FIGS. 4C to 4E and 6C to 6E, when the lock button 243 is pressed by the user and the bottom frame 240 is continuously pulled in the X-axis direction (for example, direction 302), the door guard 210 starts (for example, the bottom frame 240 linearly moves from the second location to a third location) to rotate counterclockwise (for example, direction 303). When the bottom frame moves from the second location to the third location, the door guard 210 may rotate by the gear 242.

When the bottom frame 240 is continuously pulled in the X-axis direction (for example, direction 302) by the user, the door guard 210 connected to the gear 242 that rotates by the engagement of the gear tooth 242*b*1 with the rack gear tooth 131*c*1 starts to rotate counterclockwise. The gear 242 has the gear tooth 242*b* by some angle α, and therefore may rotate while being engaged with the rack 131*c* as many as the number of gear teeth 242*b* corresponding to the angle α. The door guard 210 also rotates corresponding to the rotation direction (for exempla, either counterclockwise or clockwise (for example, direction 305, refer to FIG. 6F)) of the gear 242.

In the rotation guard unit 200 according to another exemplary embodiment of the present disclosure, the rotation direction of the door guard 210 may be changed depending on the locations of the gear 242 and the rack 131*c*. Referring to FIG. 6A, when the location of the rack 131*c* moves by the same distance in the Y-axis direction with respect to a center 242*a* of the gear 242 (for example, moves in a vertical symmetry), a gear tooth 242*cn* of the gear 242 and the rack gear tooth 131*c*1 may contact each other. When the gear tooth 242*bn* of the gear 242 and the rack gear tooth 131*c*1 contact each other, the door guard 210 may rotate clockwise (for example, direction 305).

The gear 242 has the gear tooth 242*b* by some angle α, and therefore may move in the X-axis direction while being engaged with the rack 131*c* as many as the number of gear teeth 242*b* corresponding to the angle α. Further, the bottom frame 240 may move in the X-axis direction depending on a rotation angle of the door guard 210 that the user wants.

When the gear 242 engaged with the rack 131*c* moves by a distance l3 from the second location, the door guard 210 may rotate by 90°. For example, the distance l3 may be 41 mm. Further, the distance l3 may be 30 to 50 mm.

When the gear 242 engaged with the rack 131*c* moves by a distance l4 from the second location (for example, reaches the third location), the door guard 210 may rotate by 180°. For example, the distance l3 may be 82 mm. Further, the distance l4 may be 70 to 90 mm.

It will be easily understood by a person having ordinary skill in the art that the distances l3 and l4 may be changed depending on the number of gear teeth 242*b* and/or the number of gear teeth of the rack 131*c*, modules of the gear 242 and the rack 131*c* corresponding to the size of the gear tooth, or a pressure angle. If the module is increased, the size of the gear tooth is increased. Only when the modules are the same, the gear 242 and the rack 131*c* may be engaged with each other and a driving force may be transferred. The larger the pressure angle, the sharper the tooth profile.

As the external force of the user pulling the bottom frame 240 in the X-axis direction (for example, direction 302) is increased, the bottom frame 240 may quickly move in the X-axis direction in response to the external force. As the gear 242 and the rack 131*c* are engaged with each other and the external force of the user pulling the bottom frame 240 in the X-axis direction (for example, direction 302) is increased, a rotation speed of the door guard 210 may be fast in response to the external force.

The inner guard member 211 and the outer guard member 212 with respect to the rotating shafts 213 and 231 may rotate in the gap (for example, 0.3 mm to 2 mm or less) spaced between the inner guard member 211 and/or the outer guard member 212 and the side frame 220.

In the gear 242, when a final gear tooth 242*bn* is engaged with the rack 131*c* (for example, reaches the third location), the door guard 210 of the rotation guard unit 200 may rotate by 180° with respect to the first location. When the bottom frame 240 further moves in the X-axis direction and thus in the gear 242, the area without the gear tooth 242*b* is located at a gear tooth 131*bn*-1 of the rack 131*c*, the door guard 210 does not have engagement with lack gear 131*c* and therefore may not rotate any more.

In the gear 242, when one (for example, 242*bn*-1) of the gear tooth 242*b* is engaged with the gear tooth 131*cn* of the rack 131*c* (for example, third location), the door guard 210 of the rotation guard unit 200 may rotate by 180° with respect to the first location. When the bottom frame 240 further moves in the X-axis direction and thus one 242*bn*-1 of the gear tooth 242*b* is located passing through the gear tooth 131*cn* of the rack 131*c*, the door guard 210 does not have engagement and therefore may not rotate any more.

The user may select the beverage container received in the door guard 210 rotating by 180°. The beverage containers received in both sides (for example, direction of the second door direction and direction of the storage room) of the door guard 210 may be taken out by rotating the door guard 210 of the rotation guard unit 200 without opening the third door 131.

Figure 6D:
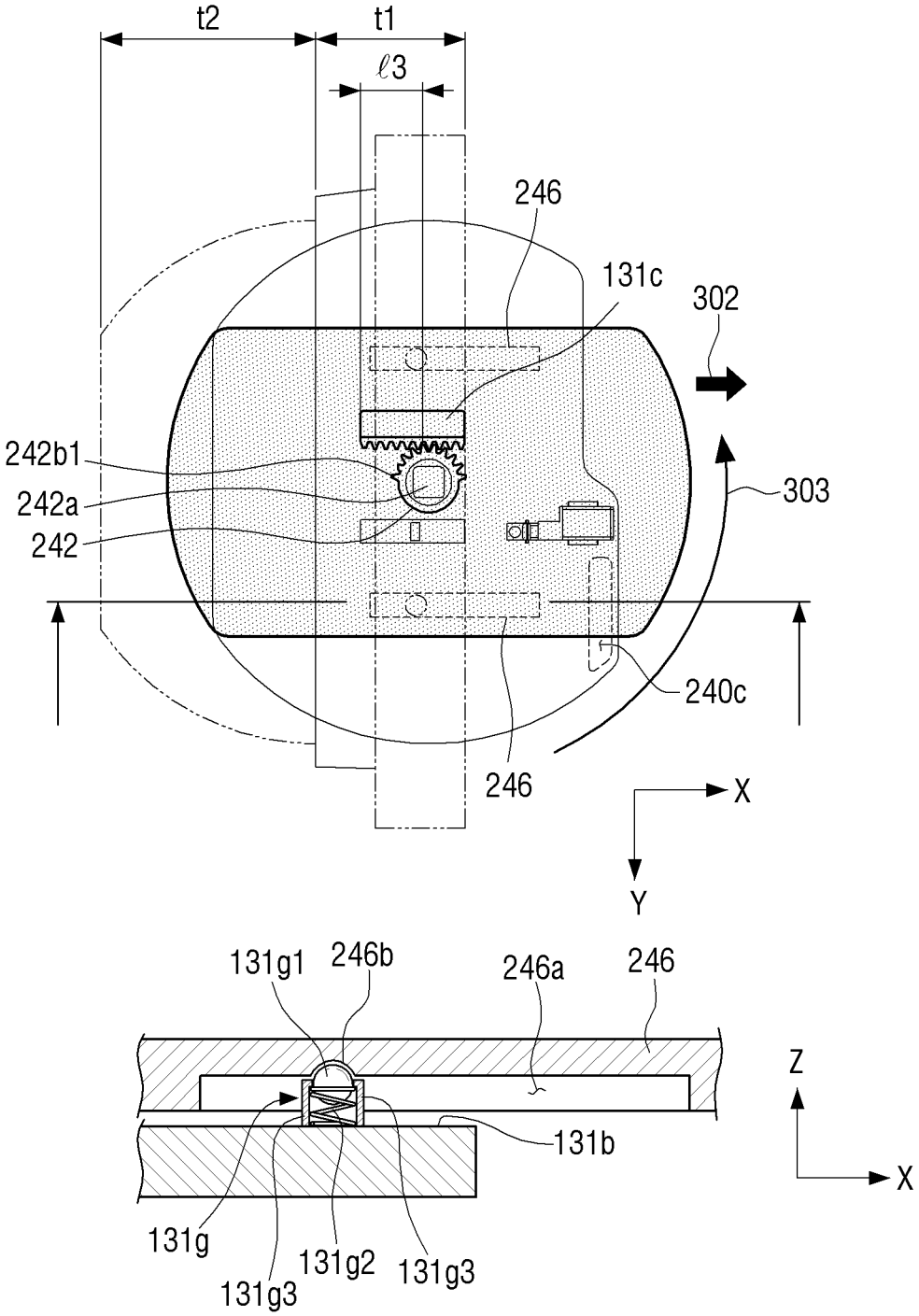
Figure 6E:
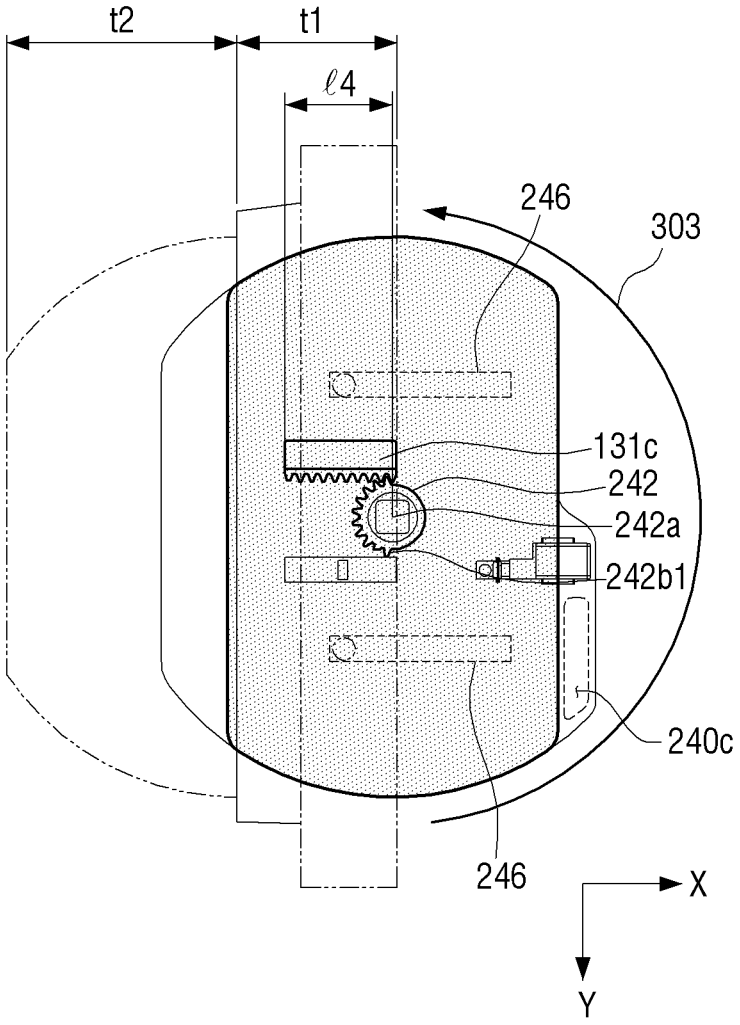

Referring to FIG. 6D, one or plural concave holes 246*b* may be formed in a bottom groove 246*a* of the guide rail 246. Further, a fixed elastic projection 131*g* may be located on the inner bottom surface 131*b* facing the guide rail 246. The elastic projection 131*g* includes a bearing 131*g*1 rolling the bottom groove 246*a* of the guide rail 246, the elastic member (for example, spring 131*g*2) elastically supporting the bearing 131*g*1, and a housing 131*g*3 fixed to the inner bottom surface 131*b* and receiving the bearing 131*g*1 and an elastic member 131*g*2.

The concave hole 246*b* may correspond to the rotation angle of the rotating door guard 210. For example, when the door guard 210 rotating from the first state (in the case of 0°) reaches 30°, 45°, 60°, 90°, 120°, 135°, 150°, and/or 180°, the rotation of the door guard 210 may be limited by at least one concave hole 246*b*. When the door guard 210 reaches 180°, the rotation of the door guard 210 may stop by the concave hole 246*b*.

Figure 6F:
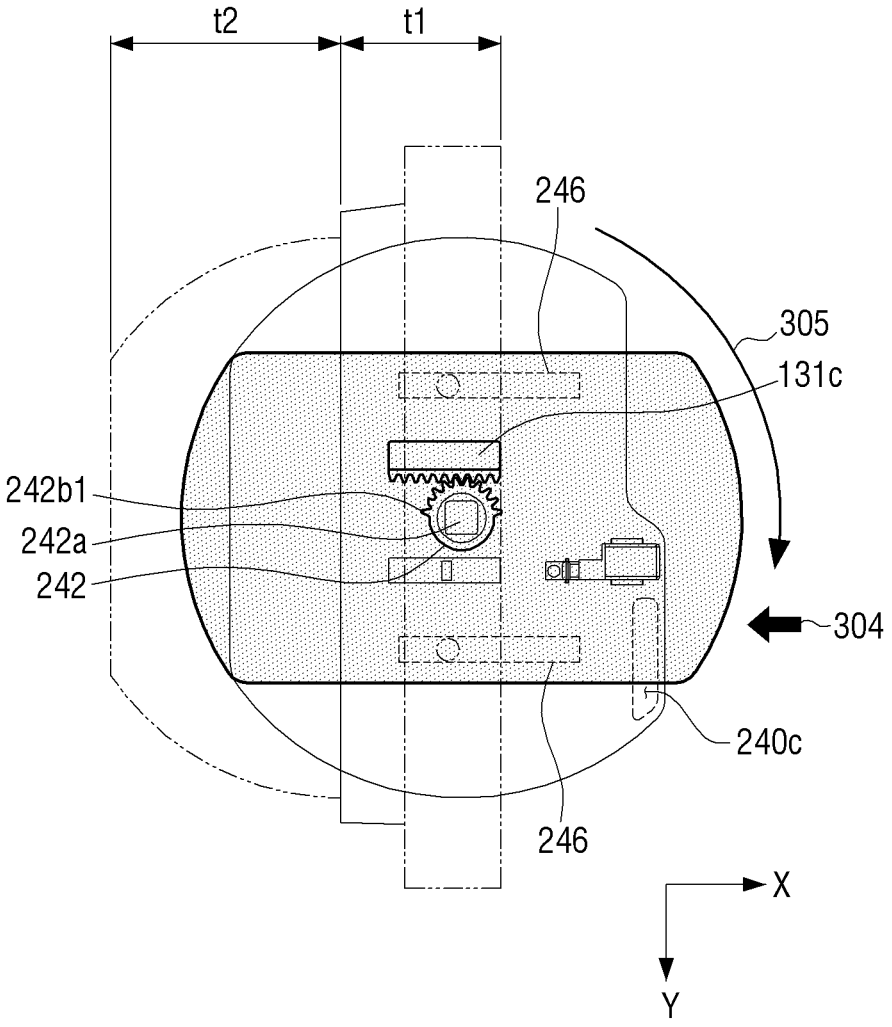
Figure 6G:
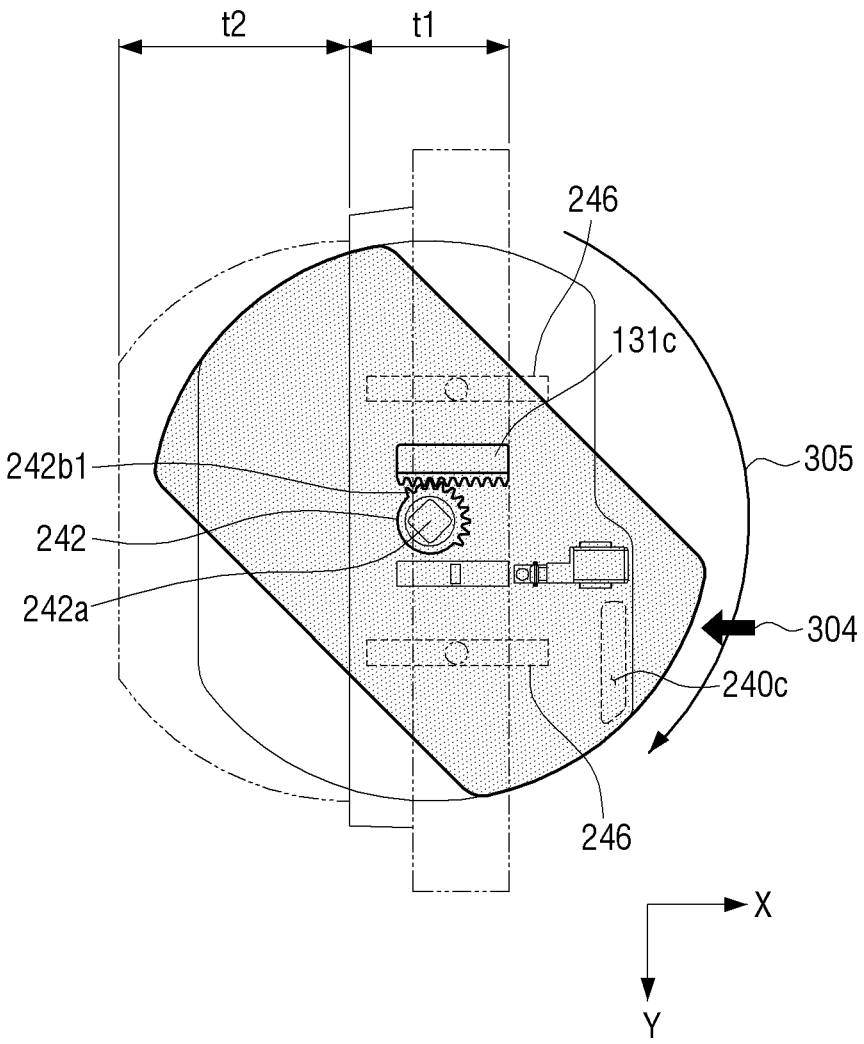
Figure 6H:
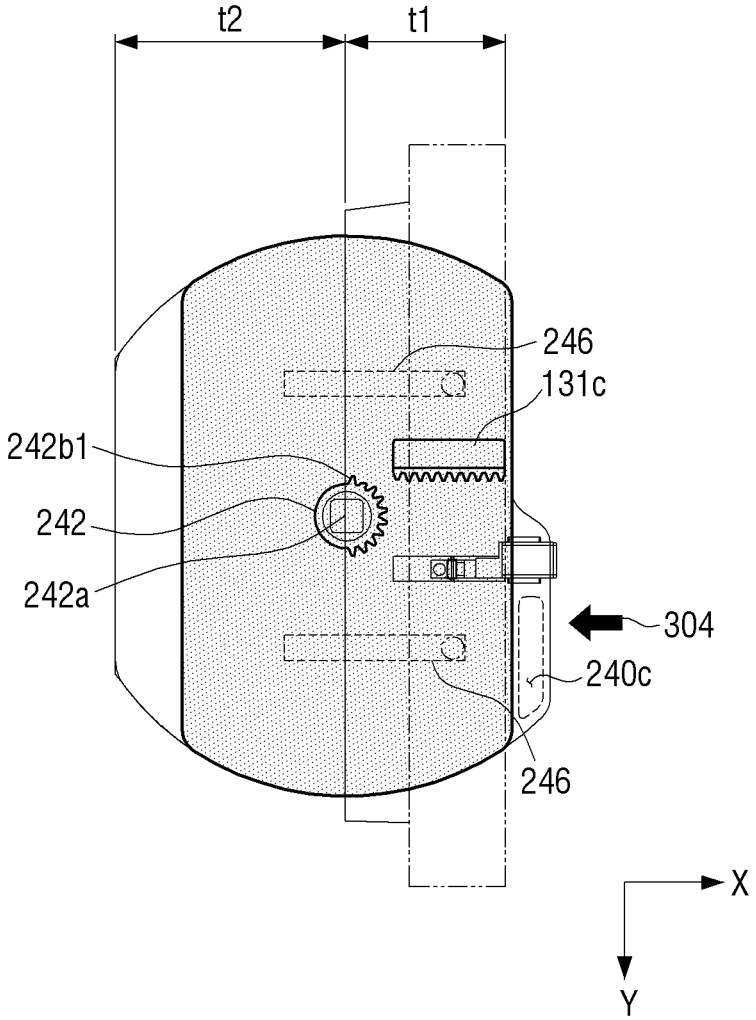

Referring to FIGS. 6F to 6H, the door guard 210 may rotate in an opposite direction (for example, clockwise) to the rotation direction of FIGS. 6A to 6E.

If the bottom frame 240 is pushed in the −X-axis direction (for example, direction 304) by the user, the gear tooth 242*bn* may be engaged with the gear tooth 131*cn* of the rack 131*c*. If the bottom frame 240 is continuously pushed in the −X-axis direction (for example, direction 304) by the user, the door guard 210 rotates clockwise (direction 305).

In FIGS. 6A to 6H, the clockwise rotation of the door guard 210 is substantially similar to the counterclockwise rotation of the door guard 210 in FIGS. 6F to 6H and therefore the overlapping description thereof will be omitted.

The present disclosure relates to the refrigerator having the door guard rotating clockwise or counterclockwise.

Hereinabove, although the present disclosure is described by specific matters such as concrete components, and the like, exemplary embodiments, and drawings, they are provided only for assisting in the entire understanding of the present disclosure. Therefore, the present disclosure is not limited to the exemplary embodiments. Various modifications and changes may be made by those skilled in the art to which the present disclosure pertains from this description.

Therefore, the spirit of the present disclosure should not be limited to these exemplary embodiments, but the claims and all of modifications equal or equivalent to the claims are intended to fall within the scope and spirit of the present disclosure.

What is claimed is:

1. A refrigerator, comprising:

a main body having a storage room;

a first door hinge-connected to the main body to rotate at a front of one side of the storage room and having an opening;

a second door to rotate at the front of the first door to open and close the opening;

a third door hinge-connected to the main body to rotate at a front of another side of the storage room; and a rotation guard to rotate while being located at the opening of the first door, the rotation guard including:

a door guard having a rotating shaft, the rotating shaft of the door guard being passable through the opening to connect to a gear, and a bottom frame located at a lower end of the door guard and movable on a bottom surface of the first door, the bottom frame having an opening, and wherein the gear rotates in response to a contact with a rack located on the bottom surface of the first door according to a movement of the bottom frame.

2. The refrigerator as claimed in claim 1, wherein the rotation guard further includes:

side frames extending in a height direction of the refrigerator to be spaced apart from both sides of the door guard and a top frame located at an upper end of the door guard and connected to one end of the side frames, wherein the bottom frame has a protruding area protruding toward a front of the storage room, and connected to another end of the side frames, and the door guard has a plurality of rotating shafts located on a same shaft line.

3. The refrigerator as claimed in claim 2, wherein the side frames are located to be apart from both sides of the door guard.

4. The refrigerator as claimed in claim 2, wherein the bottom frame further includes a lock button located at a front surface of the protruding area and when locking of the bottom frame is released by the lock button, the bottom frame moves in a predetermined direction.

5. The refrigerator as claimed in claim 1, wherein the gear has a plurality of gear teeth and the plurality of gear teeth are disposed at the gear at an angle smaller than 360°.

6. The refrigerator as claimed in claim 1, wherein the gear has a plurality of gear teeth and some of the plurality of gear teeth has a size smaller than that of other gear teeth.

7. The refrigerator as claimed in claim 1, wherein a number of gear teeth of the gear corresponds to a moving distance of the rotation guard.

8. The refrigerator as claimed in claim 1, wherein modules of gear teeth of the rack engaged with the gear teeth of the gear are the same.

9. The refrigerator as claimed in claim 1, wherein a linear moving distance from a first location of the gear to a second location is shorter than that from the second location of the gear to a third location.

10. The refrigerator as claimed in claim 1, wherein a rotation direction of the rotation guard is changed depending on locations of the gear and the rack that are engaged with each other.

11. The refrigerator as claimed in claim 1, wherein in an overall width of the door guard, a width in a direction of the storage room is larger than that in the front of the storage room, with respect to a center of the gear.

12. The refrigerator as claimed in claim 2, wherein when the second door is closed, the second door has a groove receiving the protruding area.

13. The refrigerator as claimed in claim 12, wherein the second door includes a fixed door guard that does not overlap the door guard of the rotation guard.

14. The refrigerator as claimed in claim 1, wherein the storage room includes a fridge or a freezer and the rotation guard is located at at least one of the fridge and the freezer.

* * * * *